US005278743A

United States Patent [19]

Bengel et al.

[11] Patent Number: 5,278,743

[45] Date of Patent: Jan. 11, 1994

[54] ALKALINE-PERMANGANATE PROCESS

[75] Inventors: Thomas G. Bengel, Plum Borough, Pa.; John F. Remark, Gainesville, Fla.

[73] Assignee: Westinghouse Electric Corp., Pittsburgh, Pa.

[21] Appl. No.: 979,716

[22] Filed: Nov. 20, 1992

[51] Int. Cl.[5] ..... G21C 19/42

[52] U.S. Cl. ..... 376/310; 376/305

[58] Field of Search ..... 376/308, 309, 310, 305

[56] References Cited

U.S. PATENT DOCUMENTS 4,731,124 3/1988 Bradbury et al. ..... 376/310

5,093,073 3/1992 Schenker ..... 376/310

*Primary Examiner*—Donald P. Walsh

*Assistant Examiner*—Frederick H. Voss

*Attorney, Agent, or Firm*—J. C. Valentine

[57] ABSTRACT

An alkaline-permanganate process for chemically decontaminating oxidized metal surfaces wetted by primary water circulating in cooling loops of nuclear reactors maintains permanganate-containing primary water at a temperature of about 90° C. and at a pH of 9–12 to oxidize the wetted surfaces. Oxalic acid is then added to the water and the oxalic acid-containing primary water is maintained at a temperature of at least about 90° C. and at a pH of about 5–7 while it is circulated to destroy the permanganate ions and manganese dioxide.

10 Claims, No Drawings

ALKALINE-PERMANGANATE PROCESS

BACKGROUND OF THE INVENTION

The invention relates to an alkaline-permanganate process for oxidizing metal oxides on surfaces wetted by aqueous solutions and more particularly to a process for oxidizing metal oxides which tend to form on the surfaces of primary cooling water systems in nuclear power plants. The invention is particularly useful for decontaminating nuclear plants and thereby reducing the radiation exposure of workers during routine maintenance and operating activities, reactor refueling and plant decommissioning.

As a nuclear power plant operates, the surfaces of the primary water loops tend to corrode slightly and form surface oxides of iron, chromium, nickel, cobalt and other metals employed in the loop. The corrosion products (referred to in the nuclear industry as "crud") are transported by the water to the core region of the reactor and become radioactive. Subsequently, the radioactivate corrosion products are retransported throughout the primary water loop and increase the radiation fields throughout the plant. In addition, radioactive ions such as cobalt 60 deposit on these surface oxides. These corrosion products are the principal source of the out-of-core radiation fields and make the greatest contribution to personnel radiation exposure.

Various dilute chemical decontamination processes have been developed for dissolving the metal oxides and recovering the dissolved ions on resin beds and filters. Permanganate processes have been developed to oxidize such metal oxides as chromium (III) oxide. In alkaline-permanganate processes, primary water containing potassium permanganate and sodium hydroxide is circulated through the coolant loop to oxidize chromium (III) oxide to chromium (VI) oxide, which is soluble in aqueous alkaline solutions. After the permanganate-containing water has been circulated for up to several hours, the residual amounts of permanganate in the water and manganese dioxide formed in the chromium oxide oxidation step are reduced to manganous ions with oxalic acid, citric acid, EDTA and the like. In acid-permanganate processes, primary water containing potassium permanganate and nitric acid is circulated through the loop to oxidize the chromium oxides. However, the permanganate ions are reduced to manganous ions in acid solutions.

These permanganate oxidation processes are normally combined with other known processes which reduce such metal oxides as ferric oxide and nickel oxides (e.g., $NiFe_2O_4$) at the surface to acid soluble oxides. In the proprietary Can-Decon and Can-Derem processes, primary water containing organic acids and typically having a pH of about 2.5–3 is circulated through the coolant loop. In the LOMI (Low Oxidation-state Metal Ion) process, primary water containing vanadous formate and picolinic acid and typically having a pH of about 4–6 is circulated through the coolant loop. For a general discussion of these and other processes, see J. A. Ayres, "Decontamination of Nuclear Reactor and Equipment", Ronald Press Co., New York, 1970, and T. Suwa, "Development of Chemical Decontamination Process with Sulfuric Acid-Cerium (IV) for Decommissioning", J. of Nuclear Science and Technology, 23(76), pp 622–632, July 1986.

In practice, a succession of alternating permanganate oxidation steps and reduction steps are performed to dissolve the surface oxides and thereby to decontaminate reactor systems to acceptably low levels.

Alkaline-permanganate processes are particularly effective in oxidizing metal oxides. It has been estimated that up to about 4,500 man-rem of exposure may be saved by decontaminating a fueled reactor and that up to about 3,500 man-rem of exposure may be saved by decontaminating a defueled reactor before work is begun on it. In these processes, the pH of the circulating permanganate-containing water is generally maintained in the range of 9–12. In the following permanganate destruction step, oxalic acid is added and the pH of the primary water is reduced to 4–5 in order to effectively reduce the residual permanganate ions and the manganese dioxide (from the oxidation of chromium oxides) to manganous ions.

The maximum water temperature is closely controlled during the alkaline-permanganate process because the system is highly susceptible to corrosion by the chemicals employed to decontaminate the system. Thus, the permanganate-containing water temperature is maintained at a maximum of about 90° C. (190° F.) in the chromium oxidation step and the temperature is then lowered to below a maximum of about 80° C. (175° F.) in the permanganate destruction step in order to minimize corrosion of the loop. The metals normally employed in current systems are particularly sensitive to intergranular stress corrosion cracking caused by solutions containing more than about 1000 ppm oxalic acid at temperatures of 90° C.

Undesireably, substantial amounts of large visible manganese dioxide particles tend to form in alkaline-permanganate processes when oxalic acid is added to the permanganate-containing water and its pH is lowered from the 9–12 range to the 4–5 range. These manganese dioxide particles may easily plug resin beds, filters and other process equipment and piping in low fluid velocity areas. In addition, these particles may remain in the system survive following decontamination steps and adsorb cobalt 60 ions.

SUMMARY OF THE INVENTION

It is an object of the present invention to oxidize metal oxides on surfaces wetted by an aqueous solution via an alkaline-permanganate process and then to destroy the residual permanganate ions in the solution after the oxidation step without plugging the process equipment and piping with manganese dioxide particles.

It is a further object of the present invention to destroy the residual permanganate ions at higher temperatures than are presently employed in the nuclear industry in order to more efficiently decontaminate primary water coolant systems.

With these objects in view, the present invention resides in an alkaline-permanganate process wherein permanganate ions are added to an aqueous solution in order to oxidize metal oxides on surfaces of the system which are wetted by the solution. The permanganate-containing solution is preferably maintained at a temperature of at least about 90° C. and at a pH of at least about 9 in order to efficiently oxidize the surface metal oxides.

Oxalic acid is then added to the solution in order to destroy the permanganate ion and manganese dioxide which forms in the oxidation step. Importantly, the oxalic acid-containing solution is maintained at a temperature of at least about 90° C. and at a pH of greater than about 5 during the permanganate destruction step, which is contrary to the conventional wisdom of reducing the pH to the lowest practical level (of 4–5) in order to promote the dissolution of the manganes-e dioxide to the manganous ion while maintaining the temperature at a maximum of about 80° C. in order to minimize (and preferably to prevent) intergranular stress corrosion cracking.

The practice of the present invention is particularly useful for decontaminating reactor coolant systems in pressurized water reactors employing aqueous solutions containing substantial amounts of boron ions. In a preferred practice of the present invention, the primary water contains at least about 25 ppm boron. The primary water preferably contains at least about 650 ppm boron at the end of a fuel cycle in a cold shutown and preferably at least about 2,500 ppm boron in cases where fuel is in the core of the reactor in order to avoid criticality. The permanganate-containing water perferably contains about 500 ppm to about 1500 ppm permanganate and is maintained at a temperature of at least about 100° C. and at a pH of at least about 10 during the oxide dissolution step. The oxalic acid-containing water preferably contains at least about 10 ppm excess oxalic acid and is maintained at a temperature of at least about 100° C. and at a pH of about 6.5 to 7 during the permanganate destruction step. The invention may be practiced in other reactor environments in addition to this pressurized water reactor system.

DESCRIPTION OF THE PREFERRED PRACTICE

Other advantages of the present invention will become more apparent from the following detailed description of a preferred practice thereof.

In the preferred alkaline-permanganate practice, the oxidized metal surfaces in the primary coolant system of a pressurized water nuclear reactor are oxidized and dissolved with a permanganate such as potassium permanganate and a hydroxide source such as sodium hydroxide. Other reactants may be alternatively employed, but potassium permanganate and sodium hydroxide are generally more economical. The primary water in such a system will contain at least about 25 ppm boron during much of the cyle (and about 650 ppm at the end of a fuel cycle and more than about 2500 ppm on a cold shutdown), up to about 1 ppm lithium and no more than about 150 ppm total of chlorides, fluorides and sulfates. The metals in the system wetted by the water will normally include Type 304 and 316 stainless steel, Inconel 600, X-750, Stellite 6 and 156 and other metals containing substantial amounts of chromium, iron and nickel.

In the permanganate oxidation step, the potassium permanganate is preferably added to the primary water to maintain a permanganate ion concentration of between about 500 ppm and about 1500 ppm. The sodium hydroxide is preferably added to maintain the pH of the permanganate-containing primary water between about 9 and 12, and more preferably in the range of 10.5–11.5. The water is maintained at a temperature of at least about 90° C. (190° F.) while the water is circulated through the system. The permanganate ions in the circulating water solution are reduced to insoluble manganese dioxides which do not grow to a size large enough to interfere with the process and the water tends to remain clear. At least some of the oxidized chromium oxides dissolve into the primary water.

In the following permanganate destruction step, oxalic acid is preferably added to the permanganate-containing water to maintain a at least an excess of 10 ppm oxalic acid and, more preferably, a minimum oxalic acid concentration of between about 100–500 ppm and a maximum oxalic acid concentration of about 750 ppm. The oxalic acid may be present in concentrations of up to 1000 ppm or more, but it is normally preferred to maintain the free oxalate concentration below about 750 ppm in order to minimize corrosion. Preferably, the acid addition alone is sufficient to lower the pH down to 5–7. If the boron ion concentration is high, hydronium ions may need to be added from another source because high concentrations of boron tend to buffer the water. In prior practices, hydronium ions were added by acid addition or via a strong cation resin exchanger to lower the pH to 4–5. In addition, the water temperature is preferably maintained at a relatively high minimum temperature of about 90° C. (190° F.) rather than cooling the primary water down to about 70° C. (160° F.) as has been conventional practice.

It has been found that the primary water becomes clearer during the permanganate destruction step and that there is little, if any, plugging by manganese dioxide when the permanganate is destroyed at relatively high temperatures and a relatively high pH. Although the precise mechanism is not fully understood, it is believed that under these reaction conditions the permanganate ions are rapidly reduced from the permanganate to the manganous state so that any intermediate manganese dioxide insolubles which may form (if they form at all) are no larger than colloidal size.

Importantly, although the permanganate ions and the oxalate ions are very aggressive at temperatures of 90° C. (190° F.) and above and these ions would be expected to provide a highly corrosive environment, it has been found that there is substantially no detectable corrosion where the oxalic acid-containing solution is circulated at a pH of at least about 5 for up to about an hour. In a test conducted in a small test loop, a simulated primary water solution containing up to about 780 ppm maximum of free oxalate was circulated for about 54 minutes at a temperature of 100° C. (212° F.) and at a pH of 6.5–7. Test coupons immersed in the loop were examined and no intergranular corrosion was identified.

After the free oxalate concentration of the primary water has stabilized for a suitable length of time, the primary water may be valved to resin beds for removing the metal ions (on a cation bed) and the oxalate ions (on a anion bed). Preferably, the conductivity of the primary water is reduced to less than about 50 micromhos/cm and more preferrably less than about 10 micromhos/cm before the process is completed.

The alkaline-permanganate process may be followed by a Can-Derem, Can-Decon, LOMI or other process for dissolving iron and nickel surface oxides on the wetted surfaces. Preferably, a series of alternating processes are employed to dissolve the surface oxides without significantly corroding the metals in the system during the decontamination process.

While a present preferred practice of the present invention has been described, it is to be understood that the invention may be otherwise variously embodied within the scope of the following claims of invention.

What we claim is:

1. An alkaline-permanganate process, comprising the steps of:

adding permanganate ions to an aqueous solution to oxidize metal oxides on surfaces wetted by the solution;

maintaining the permanganate-containing solution at a temperature of at least about 90° C. and at a pH of about 9–12;

adding oxalic acid to the permanganate-containing solution to reduce the residual permanganate ions to manganous ions; and maintaining the oxalic acid-containing solution at a temperature of at least about 90° C. and at a pH of about 5–7.

2. The process of claim 1, wherein the temperature of the oxalic acid-containing solution is maintained at a temperature of at least about 100° C.

3. The process of claim 1, wherein the pH of the oxalic acid-containing solution is maintained above about 6.

4. The process of claim 1, wherein the oxalic acid-containing solution is maintained for at least about one hour at a temperature of at least about 100° C. and at a pH of between about 6–7.

5. An alkaline-permanganate chemical decontamination process for oxidizing metal oxides on surfaces wetted by a circulating aqueous stream, comprising the steps of:

circulating an aqueous stream containing at least about 25 ppm boron past a metal oxide surface;

adding permanganate ions to the circulating aqueous stream to oxidize the surface wetted by the stream and thereby to produce manganese dioxide;

adding oxalic acid to the circulating permanganate-containing stream to reduce the permanganate ions and the manganese dioxide to manganous ions;

maintaining the circulating oxalic acid-containing stream at an oxalic acid concentration of at least about 10 ppm oxalic acid, at a temperature of at least about 100° C. and at a pH of from about 6 to about 7; and then reducing the conductivity of the stream to less than about 50 micromhos/cm.

6. The process of claim 5, wherein the oxalic acid concentration is maintained in the range of from about 100 ppm to about 750 ppm to reduce the permangnate ions to manganous ions.

7. The process of claim 6, wherein the oxalic acid concentration is maintained in the range of from about 500 ppm to about 750 ppm.

8. The process of claim 5, wherein the boron concentration of the water is at least about 650 ppm.

9. The process of claim 8, wherein the boron concentration of the water is at least about 2500 ppm.

10. The process of claim 5, wherein the conductivity of the stream is reduced to less than about 10 micromhos/cm.

* * * * *